US006195047B1

(12) United States Patent
Richards

(10) Patent No.: US 6,195,047 B1
(45) Date of Patent: Feb. 27, 2001

(54) INTEGRATED MICROELECTROMECHANICAL PHASE SHIFTING REFLECT ARRAY ANTENNA

(75) Inventor: Randy J. Richards, Frisco, TX (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/181,457

(22) Filed: Oct. 28, 1998

(51) Int. Cl.[7] ..... H01Q 1/38

(52) U.S. Cl. ..... 343/700 MS; 343/754; 343/853

(58) Field of Search ..... 343/700 MS, 701, 343/853, 854; H01Q 1/38

(56) References Cited

U.S. PATENT DOCUMENTS

| | | | |
|---|---|---|---|
| 4,053,895 | 10/1977 | Malagisi | 343/700 |
| 4,684,952 | 8/1987 | Munson et al. | 343/700 |
| 4,777,490 | 10/1988 | Sharma et al. | 343/754 |

OTHER PUBLICATIONS

Colin, Jean–Marie, "Phased Array Radars in France: Present & Future", IEEE, pp. 458–462, Jun. 1996.

Huang, John, "Bandwidth Study of Microstrip Reflectarray and a Novel Phased Refletcarray Concept", IEEE, pp. 582–585, May 1995.

Huang, John and Ronald J. Pogorzelski, "A Ka–Band Microstrip Reflectarray with Elements Having Variable Rotation Angles", IEEE, vol. 46, No. 5, pp. 650–656, May 1998.

Oberhard, M.L. and Y. T. Lo, "Simple Method of Experimentally Investigating Scanning Microstrip Antenna Array without Phase–Shifting Devies", Electronic Letters, vol. 25. No. 16, pp. 1042–1043, Aug. 3, 1989.

Swenson, G.W. Jr and Y.T. Lo, "The University of Illinois Radio Telescope", IRE, pp. 9–16, Jan. 1961.

Wu, T.K., "Phased Array Antenna for Tracking and Communication with Leo Satellites", *IEEE*, pp. 293–296, Jun. 1996.

*Primary Examiner*—Michael C. Wimer
(74) *Attorney, Agent, or Firm*—Baker Botts L.L.P.

(57) ABSTRACT

A phase shifting array antenna includes antenna elements that have a non-electrically conductive substrate having first and second sides, an electrically conductive patch formed on the first side of the substrate, and a ground plane formed on the second side of the non-electrically conductive substrate. At least two pairs of integrated microelectromechanical switches are arranged diametrically opposed across the patch on the first side of the substrate, each microelectromechanical switch having a first electrode electrically coupled to the patch and a second electrode electrically coupled to the ground plane, the first and second electrodes being operable to be capacitively coupled, thereby creating a short circuit plane across the patch. A sealing structure hermetically packages the microelectromechanical switches.

27 Claims, 6 Drawing Sheets

14
21
22
23
20
30
56
40
38
36
34
32
35
48
46
50
44
42
24
26
70
71
72
74
130
76
91
93
94
90
86
82
78
80
84
88
89
100
110
112
101
102
103
104
105
114
115
116
117
118
120
121
122
123
124

INTEGRATED MICROELECTROMECHANICAL PHASE SHIFTING REFLECT ARRAY ANTENNA

RELATED PATENT APPLICATION

This application is related to U.S. Ser. No. 09/181,591, entitled Microstrip Phase Shifting Reflect Array Antenna , filed on Oct. 28, 1998, now U.S. Pat. No. 6,020,853.

TECHNICAL FIELD OF THE INVENTION

This invention is related in general to the field of antennas. More particularly, the invention is related to an integrated microelectromechanical phase shifting reflect array antenna.

BACKGROUND OF THE INVENTION

Many radar, electronic warfare and communication systems require a circularly polarized antenna with high gain and low axial ratio. Conventional mechanically scanned reflector antennas can meet these specifications. However, they are bulky, difficult to install, and subject to performance degradation in winds. Planar phased arrays may also be employed in these applications. However, these antennas are costly because of the large number of expensive GaAs Monolithic microwave integrated circuit components, including an amplifier and phase shifter at each array element as well as a feed manifold and complex packaging. Furthermore, attempts to feed each microstrip element from a common input/output port becomes impractical due to the high losses incurred in the long microstrip transmission lines, especially in large arrays.

Conventional microstrip reflect array antennas use an array of microstrip antennas as collecting and radiating elements. Conventional reflect array antennas use either delay lines of fixed lengths connected to each microstrip radiator to produced a fixed beam or use an electronic phase shifter connected to each microstrip radiator to produce an electronically scanning beam. These conventional reflect array antennas are not desirable because the fixed beam reflect arrays suffer from gain ripple over the reflect array operating bandwidth, and the electronically scanned reflect array suffer from high cost and high loss phase shifters.

It is also known that any desired phase variation across a circularly polarized array can be achieved by mechanically rotating the individual circularly polarized array elements. Miniature mechanical motors or rotators have been used to rotate each array element to the appropriate angular orientation. However, the use of such mechanical rotation devices and the controllers introduce mechanical reliability problems. Further, the manufacturing process of such antennas are labor intensive and costly.

In U.S. Pat. No. 4,053,895 entitled "Electronically Scanned Microstrip Antenna Array" issued to Malagisi on Oct. 11, 1977, antennas having at least two pairs of diametrically opposed short circuit shunt switches placed at different angles around the periphery of a microstrip disk is described. The shunt switches connect the periphery of the microstrip disk to a ground reference plane. Phase shifting of the circularly polarized reflect array elements is achieved by varying the angular position of the short-circuit plane created by diametrically opposed pairs of diode shunt switches. This antenna is of limited utility because of the complicated labor intensive manufacturing process required to connect the shunt switches and their bias network between the microstrip disk and ground, as well as the cost of the circuitry required to control the diodes.

SUMMARY OF THE INVENTION

Accordingly, there is a need for a low loss and cost effective phase shifting array antenna. In accordance with the present invention, an array element and a phase shifting array antenna are provided which eliminate or substantially reduce the disadvantages associated with prior antennas.

In one aspect of the invention, a phase shifting array antenna includes antenna elements that have a non-electrically conductive substrate having first and second sides, an electrically conductive patch formed on the first side of the substrate, and a ground plane formed on the second side of the non-electrically conductive substrate. At least two pairs of integrated microelectromechanical switches are arranged diametrically opposed across the patch on the first side of the substrate, each microelectromechanical switch having a first electrode electrically coupled to the patch and a second electrode electrically coupled to the ground plane, the first and second electrodes being operable to be capacitively coupled, thereby creating a short circuit plane across the patch. A sealing structure hermetically packages the microelectromechanical switches.

In another aspect of the invention, an antenna element includes a first portion and a second portion. The first portion includes a non-electrically conductive substrate having first and second sides, an electrically conductive patch formed on the first side of the substrate, a ground plane formed on the second side of the non-electrically conductive substrate, and lower electrodes of at least two pairs of microelectromechanical switches arranged diametrically opposed across the patch and electrically coupled to the patch. The second portion includes a controller integrated circuit, upper electrodes of the at least two pairs of microelectromechanical switches electrically coupled to the controller integrated circuit, the first and second electrodes being operable to be capacitively coupled, thereby creating a short circuit plane across the patch. The array element further includes a sealing structure disposed between the first and second portions and bonding the first and second portions together and hermetically packaging the at least two pairs of microelectromechanical switches.

In yet another aspect of the invention, an integrated phase shifting array antenna includes a non-electrically conductive substrate having first and second sides, a plurality of array elements arranged in a predetermined pattern on the first side of the substrate, and a ground plane formed on the second side of the non-electrically conductive substrate. Each array element includes an electrically conductive patch formed on the first side of the substrate, and a plurality of pairs of integrated microelectromechanical switches arranged diametrically opposed across the patch on the first side of the substrate, each microelectromechanical switch having a first electrode electrically coupled to the patch and a second electrode electrically coupled to the ground plane, the first and second electrodes being operable to be capacitively coupled, thereby creating a short circuit plane across the patch. A sealing structure is disposed about the integrated microelectromechanical switches for hermetically packaging and sealing the microelectromechanical switches.

In yet another aspect of the invention, a method of fabricating a phase shifting array antenna includes the steps of forming a plurality of electrically conductive patches arranged in a predetermined pattern on a first surface of a non-electrically conductive substrate, forming lower electrodes of at least two pairs of microelectromechanical switches disposed diametrically across each patch, forming a ground plane on a second surface of the substrate, and forming an electrical connection between each lower electrode to the ground plane. Further, the method includes the steps of forming upper electrodes of the at least two pairs of microelectromechanical switches for each patch, forming sealing structures disposed about the upper and lower electrodes of the at least two pairs of microelectromechanical switches, and bonding the sealing structures together thereby hermetically sealing and packaging the microelectromechanical switches.

BRIEF DESCRIPTION OF THE DRAWINGS

For a better understanding of the present invention, reference may be made to the accompanying drawings, in which.

DETAILED DESCRIPTION OF THE INVENTION

Figure 1:
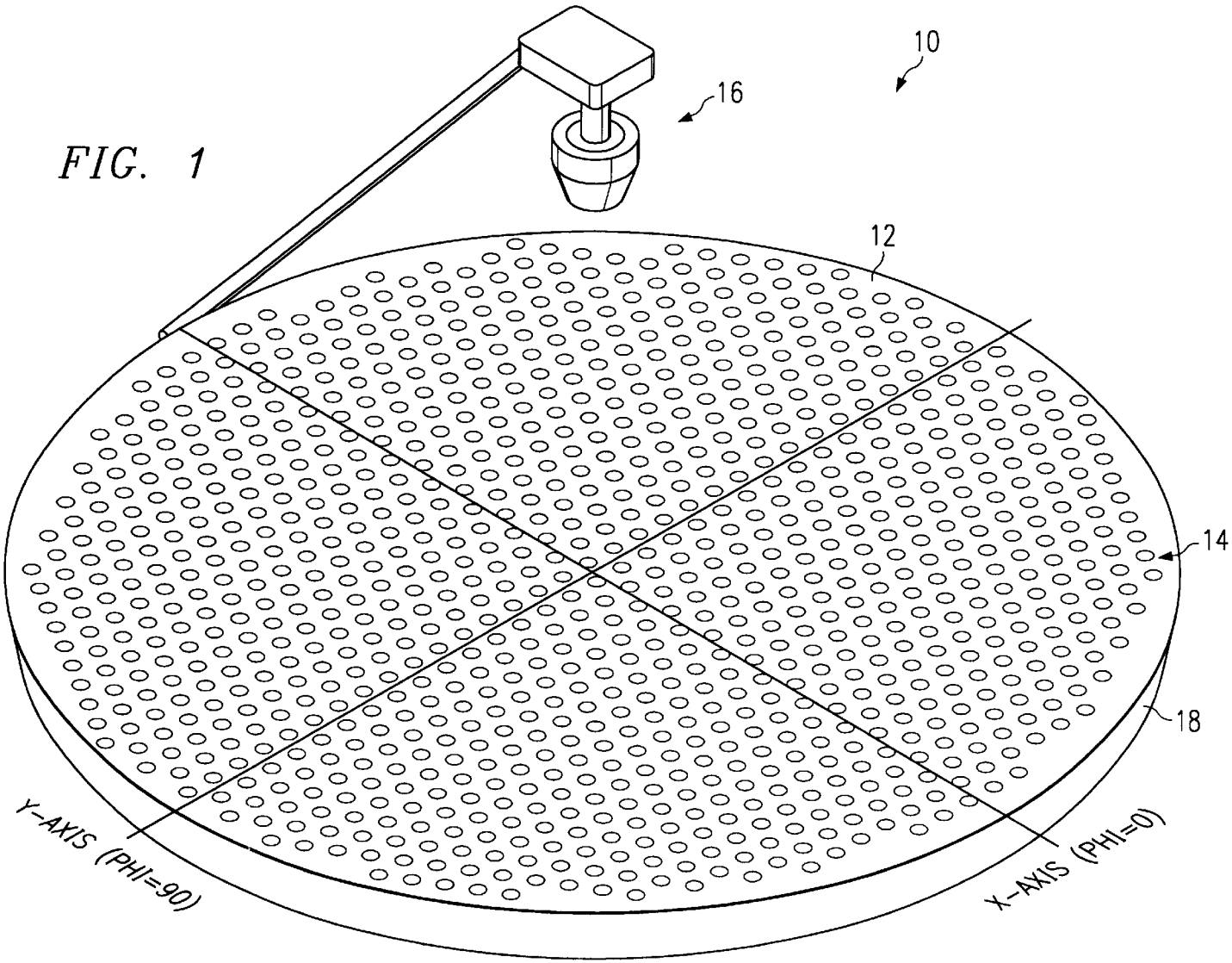
FIG. 1 is a perspective view of a microstrip phase shifting reflect array antenna shown with an offset feed horn constructed according to an embodiment of the present invention.

The preferred embodiments of the present invention are illustrated in FIGS. 1–6, like reference numerals being used to refer to like and corresponding parts of the various drawings.

Referring to FIG. 1, a microstrip phase shifting reflect array antenna 10 constructed in accordance with the teachings of the present invention is shown. Antenna 10 may include a substantially flat circular disk 12 upon which a plurality of array elements 14 are disposed in a regular and repeating pattern. As shown in FIG. 1, array elements 14 are arranged in rows and columns on disk 12. A feed horn 16 is located above disk 12, either offset (as shown) or centered, over the plurality of array elements 14. Array elements 14 may be etched on a ceramic filled PTFE substrate, which may be supported and strengthened by a thicker flat panel 18. Although antenna 10 is shown on a substantially flat substrate, the invention contemplates substrates that may be curved or conformed to some physical contour, which may be due to installation requirements or space limitations. The variation in the substrate plane geometry and the spherical wave front from the feed and to steer the beam may be corrected by modifying the phase shift state of array elements 14. Furthermore, the substrate may be fabricated in sections and then assembled on site to increase the portability of the antenna and facilitate its installation and deployment.

Figure 2B:
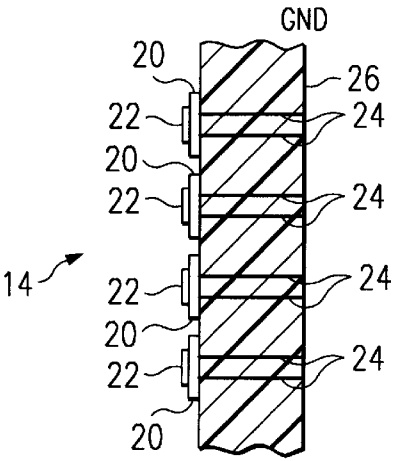
FIG. 2B is a greatly enlarged elevational cross-sectional schematic diagram of the microstrip array element constructed according to an embodiment of the present invention.
Figure 2A:
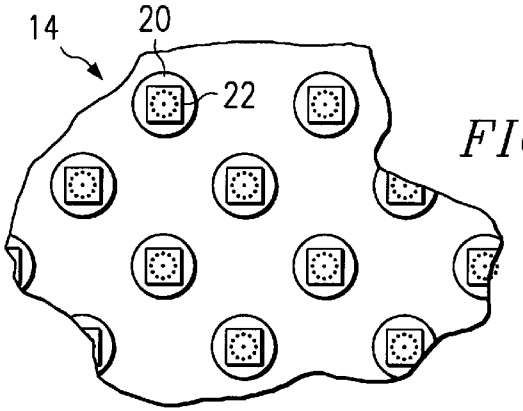
FIG. 2A is a plan view of a microstrip array element constructed according to an embodiment of the present invention.

FIGS. 2A and 2B provide a plan view and a cross-sectional schematic view of a portion of antenna 10 with a small portion of the array elements 14 thereon. Each array element 14 includes a microstrip patch 20 with integrated microelectromechanical switches and a controller 22. The dots shown as disposed on controller 22 represents at least two pairs of diametrically opposed microelectromechanical switches with the center dot representing a connection of the center of microstrip patch 20 to ground. It may be seen that the integrated microelectromechanical switches are disposed substantially equidistantly from the center of microstrip patch 20. Preferably, the switches are positioned at approximately one-third the radius from the center of microstrip patch 20. Integrated microelectromechanical switches may include 16 switches spaced 22.5° apart along a circumference. Each integrated microelectromechanical switch includes at least one connection via line 24 to a ground plane 26. Details of the structure of array element 14 are described below in reference to FIGS. 3A, 3B, 4, and 5.

In operation, varying phase shift at each array element 14 is achieved by operating pairs of the diametrically opposed switches to short microstrip patch 20 to ground, thus creating a short-circuit plane therein. Only one diametrically opposed pair of microelectromechanical switches are on or connecting the patch to ground at any instant of time. Phase shifting of the circularly polarized reflect array elements 14 is achieved by varying the angular position of the short-circuit plane created by switching between different pairs of diametrically opposed microelectromechanical switches. Operating in this manner, array elements 14 collectively form a dual circularly polarized antenna.

Figure 3A:
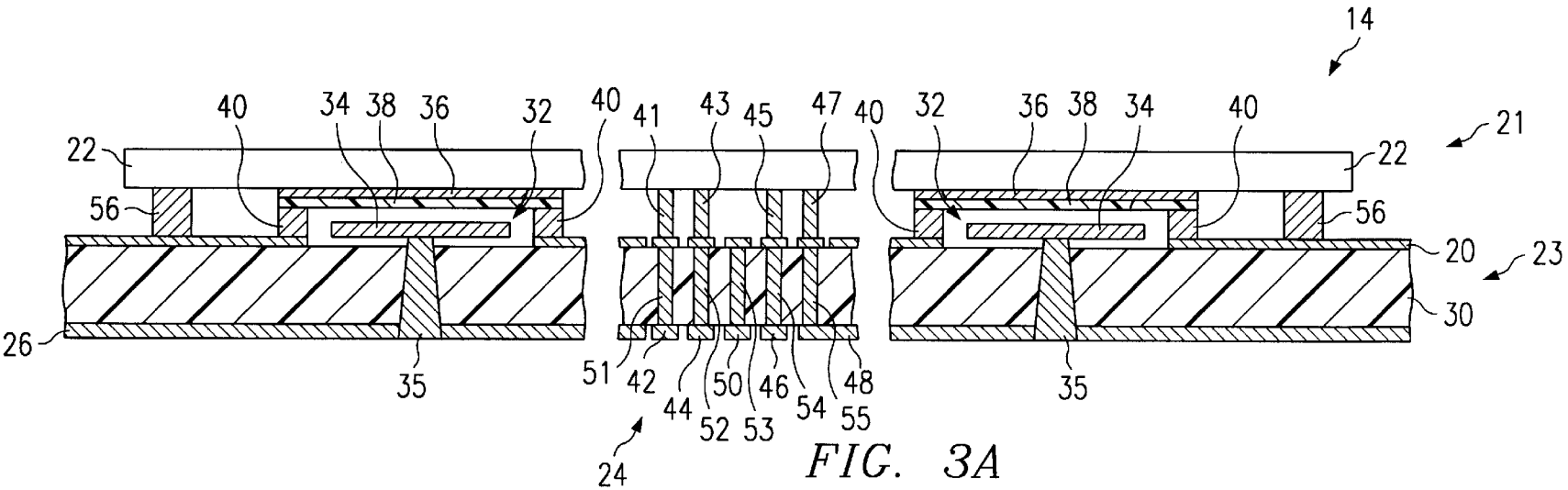
FIG. 3A is a greatly enlarged elevational cross-sectional view of the microelectromechanical phase shifting array element constructed according to an embodiment of the present invention.
Figures 3B, 4:
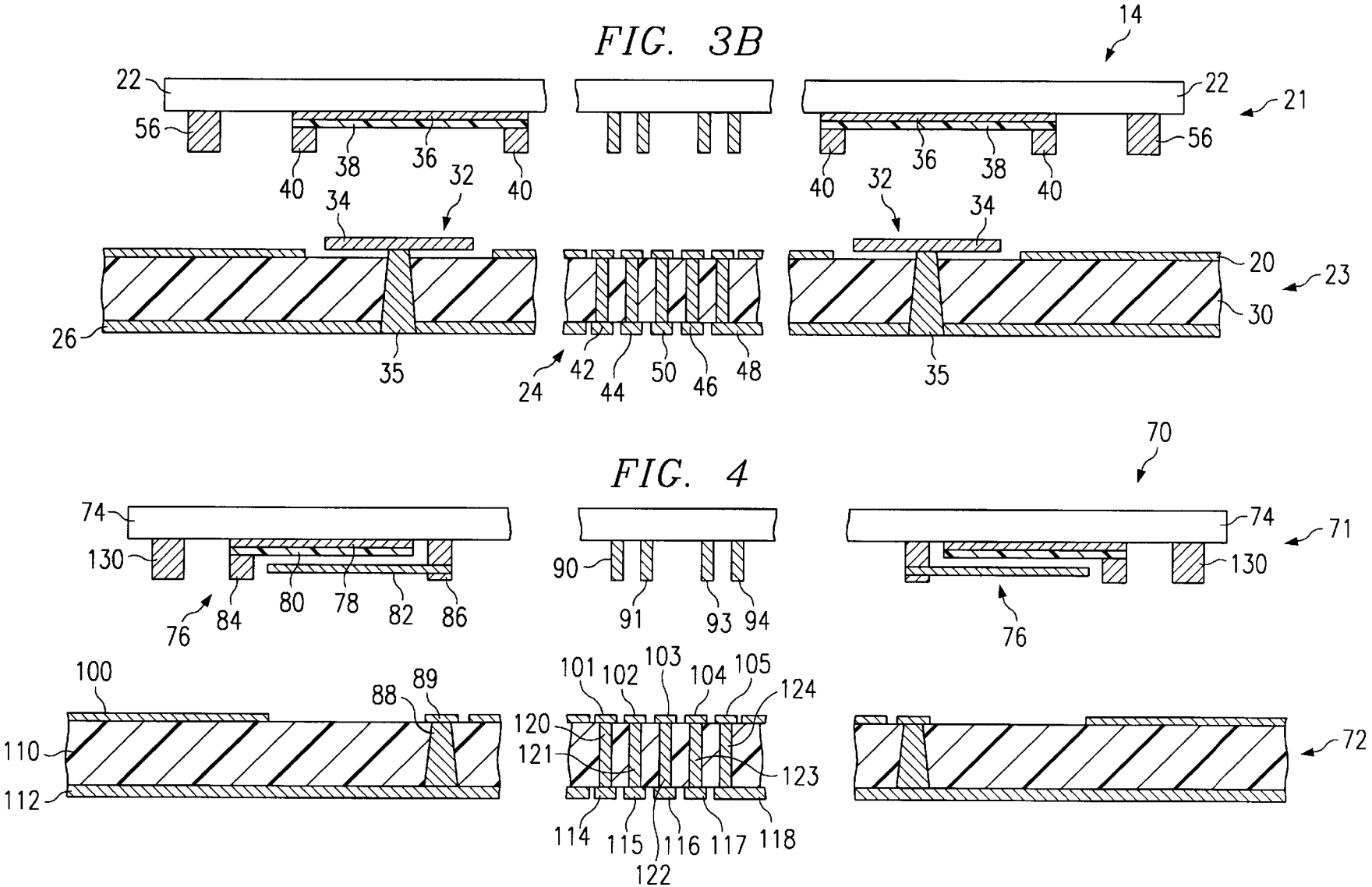
FIG. 3B is a greatly enlarged elevational cross-sectional view of the microelectromechanical phase shifting array element showing its first and second portions constructed according to an embodiment of the present invention.
FIG. 4 is a greatly enlarged elevational cross-sectional view of the microelectromechanical phase shifting array element showing its first and second portions constructed according to another embodiment of the present invention.

FIGS. 3A and 3B are greatly enlarged elevational cross-sectional views of an embodiment of array element 14 constructed according to the teachings of the present invention. Array element 14 includes a first portion 21 and a second portion 23, which may be fabricated separately and then assembled or otherwise combined and sealed together. FIG. 3A shows first and second portions 21 and 23 after assembly, and FIG. 3B shows first and second portions 21 and 23 apart yet in alignment with one another. It may be instructional to note that all the array elements on a microstrip phase shifting reflect array antenna 10 are preferably formed on a common substrate, with individual patch elements arranged in a predetermined pattern and formed on one side of the common substrate, and signal buses and a ground plane formed on the other side of the common substrate. Some or all of the signal buses are laid out and arranged to reach all of the array elements on the antenna. Each array element may include its own controller, which controls the operations of the switches of the array element.

First or upper portion 21 includes a controller 22 fabricated out of a semiconductor material such as a silicon or galium arsenide substrate. Multi-layer metalization processes are then used to fabricate a first portion 21 including upper electrodes 36 of microelectromechanical switches 32, vertical structural members 40 and sealing members 56. Lower portion 23 may include a dielectric substrate 30, a metal layer 20 on one side of dielectric substrate 30 forming the microstrip patch element, and another metal layer 26 formed on the other side of dielectric substrate 30 forming a ground plane 26. Dielectric substrate 30 may be constructed of fused quartz, for example. A plurality of vias 35 are formed through dielectric substrate 30. Vias 35 are generally arranged in a circular pattern around the center of the microstrip patch element and couples lower electrodes 34 of microelectromechanical switches 32 to ground plane 26.

In the center of array element 14 are a number of connectors 41, 43, 45, and 47 and a number of vias 51–55 through dielectric substrate 30 that serve to connect buses 42, 44, 50, 46, and 48 to controller 22. Buses 42, 44, 50, 46, and 48 are arranged on the same side of dielectric substrate 30 as ground plane 26 and may carry control signals, data signals, power, and ground signals to and from controller 22. For example, these buses may carry signals such as a serial bus, strobe, and clock signals, which may be used to supply data and control to synchronize the activation of the microelectronic switches to create phase shifting. An exemplary fabrication process is described below by referring to FIGS. 6A to 6F.

Upper electrodes 36 are electrically coupled to integrated circuits residing within controller 22. Vertical structural members 40 function to maintain a fixed spacing between upper electrodes 36 and lower electrodes 34. Sealing members 56 may be disposed near the outer perimeter of controller 22 between first portion 21 and second portion 23. Sealing members 56 function to seal off the microelectromechanical switches from contaminants present in the environment to ensure a clean contact of the switch electrodes and proper functionality. A layer of dielectric material 38 may be formed adjacent to and over upper electrodes 36 to avoid a direct metal-to-metal contact between upper and lower electrodes 36 and 34.

Controller 22 is operable to supply a positive charge or voltage to a pair of upper electrodes 36 that are diametrically opposed to one another to generate a differential voltage across the upper and lower electrodes. The electrostatic forces pulls lower electrodes 34 into contact with upper electrodes 36. When lower electrodes 34 move up sufficiently to contact upper electrodes 36 to make an electrostatic connection, upper electrodes 36 is RF coupled to microstrip patch element 20 and lower electrodes 34, and microstrip patch element 20 becomes capacitively coupled to ground. Thus a short circuit plane is created across the patch element to phase shift the signal.

FIG. 4 is a greatly enlarged elevational view of another embodiment 70 of the array element constructed according to the teachings of the present invention. Array element 70 also includes a first or upper portion 71 and a second or lower portion 72. Upper portion 71 includes a controller 74 fabricated out of a semiconductor material such as a silicon or galium arsenide substrate. Coupled to controller 74 are upper electrodes 78 of microelectromechanical switches 76, vertical structural members 84 and 86, and sealing members 130. Additionally, lower electrodes 82 are supported by and coupled to vertical structural members 86, which will meet with pads 89 on lower portion 72 after assembly of the two portions to couple lower electrodes 82 to ground. A dielectric layer 80 is formed over upper electrode 78 and between upper electrode 78 and lower electrode 82.

Lower portion 72 may include a dielectric substrate 110, a metal layer 100 on one side of dielectric substrate 110 forming the microstrip patch element, and another metal layer 112 formed on the other side of dielectric substrate 110 forming a ground plane. A plurality of vias 88 are formed through dielectric substrate 110. Vias 88 are generally arranged in a circular pattern around the center of the microstrip patch element and function to couple pads 89 to ground plane 112. Pads 89 is designed to meet up with vertical structural members 86 of upper portion 71 after the two portions are assembled.

In the center of array element 70 are a number of connectors 90–94, pad members 101–105, and a number of vias 120–124 through dielectric substrate 110 that serve to connect buses 114–118 to controller 74. Buses 114–118 may be arranged on the same side of dielectric substrate 110 as ground plane 112 and may carry control signals, data signals, power, and ground signals to and from controller 74. For example, these buses may carry signals such as a serial bus, strobe, and clock signals, which may be used to supply data and control to synchronize the activation of the microelectromechanical switches to create phase shifting. An exemplary fabrication process is described below by referring to FIGS. 6A to 6F.

Upper electrodes 78 are electrically coupled to integrated circuits residing within controller 74. Vertical structural members 86 function to maintain a fixed spacing between upper electrodes 78 and lower electrodes 82. Sealing members 130 may be disposed near the outer perimeter of controller 74 between first portion 71 and second portion 72. Sealing members 130 function to seal off the microelectromechanical switches from contaminants present in the environment to ensure a clean contact of the switch electrodes and proper functionality. The sealing members 130 act to seal off the elements when the two portions have been assembled together. A layer of dielectric material 80 may be formed adjacent to and over upper electrodes 78 to avoid a direct metal-to-metal contact between upper and lower electrodes 78 and 82.

Controller 74 is operable to supply a positive charge or voltage to a pair of upper electrodes 78 that are diametrically opposed to one another to generate a differential voltage across the upper and lower electrodes. The electrostatic force pulls lower electrodes 82 into contact with upper electrodes 78. When lower electrodes 82 move up sufficiently to contact upper electrodes 78 to make an electrostatic connection, upper electrodes 78 is RF coupled to microstrip patch element 100 and lower electrodes 82, and microstrip patch element 100 becomes capacitively coupled to ground, thus creating a short circuit plane across the patch element to phase shift the signal.

Figure 5:
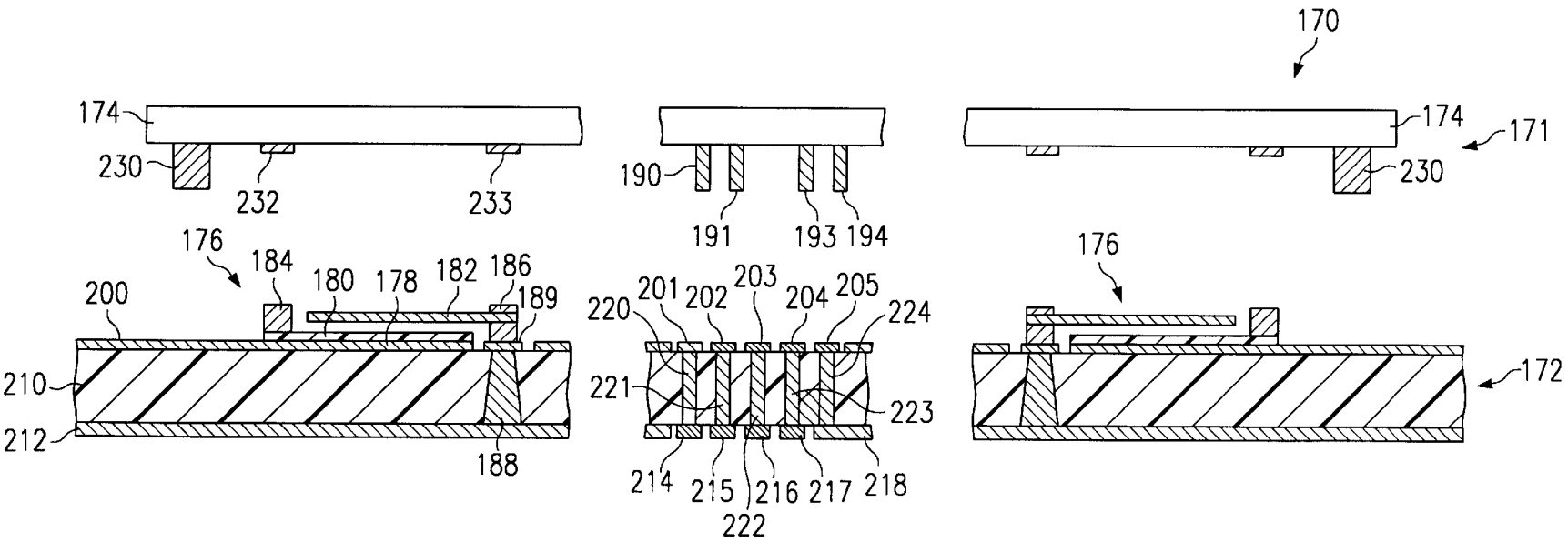
FIG. 5 is a greatly enlarged elevational cross-sectional view of the microelectromechanical phase shifting array element showing its first and second portions constructed according to yet another embodiment of the present invention.

FIG. 5 shows yet another embodiment of the array element constructed according to the teachings of the present invention. Array element 170 also includes a first or upper portion 171 and a second or lower portion 172 that are assembled together after both portions have been separately fabricated. Array element 170 is similarly constructed as array element 70 shown in FIG. 4, with the main difference that microelectromechanical switches 176 are fabricated as part of lower portion 172 rather than as part of upper portion 171.

In this embodiment, upper portion 171 includes a controller 174 fabricated out of a semiconductor material such as a silicon or gallium arsenide substrate. Coupled to controller 174 are switch support pad members 232 and 233, and sealing members 230. Switch support pad members 232 and 233 is designed to meet with vertical structural members 184 and 186 formed on lower portion 172 after the two portions are fabricated and assembled together.

Lower portion 172 may include a dielectric substrate 210, a metal layer 200 on one side of dielectric substrate 210 forming the microstrip patch element, and another metal layer 212 formed on the other side of dielectric substrate 210 forming a ground plane. A plurality of vias 188 are formed through dielectric substrate 210. Vias 188 are generally arranged in a circular pattern around the center of the microstrip patch element and function to couple upper electrode 182 of microelectromechanical switches 176 to ground plane 212. In this embodiment, lower electrodes 178 of microelectromechanical switches 176 may be formed out of a portion of patch element 200, with a layer of dielectric material 180 formed thereon. Dielectric layer 180 prevents a direct metal-to-metal contact between upper and lower electrodes 182 and 178. Vertical structural member 184 may be formed on top of dielectric layer 180, as shown. Upper electrodes 182 are generally supported by vertical structure members 186 and pad members 189, which are coupled to vias 188.

In the center of array element 170 are a number of connectors 190–194, pad members 201–205, and a number of vias 220–224 through dielectric substrate 210 that serve to connect buses 214–218 to controller 174. Buses 214–218 may be arranged on the same side of dielectric substrate 210 as ground plane 212 and may carry control signals, data signals, power, and ground signals to and from controller 174. For example, these buses may carry signals such as a serial bus, strobe, and clock signals, which may be used to supply data and control to synchronize the activation of the microelectronic switches to create phase shifting. An exemplary fabrication process is described below by referring to FIGS. 6A to 6F.

In this embodiment, lower electrodes 178 are electrically coupled to integrated circuits residing within controller 174, and upper electrodes 182 are electrically coupled to ground plane 212 through vertical support members 186 and vias 188. Vertical structural members 186 also function to maintain a fixed spacing between upper electrodes 182 and lower electrodes 178. Sealing members 230 may be disposed near the outer perimeter of controller 174 between first portion 171 and second portion 172. Sealing members 230 function to seal off the microelectromechanical switches from contaminants present in the environment to ensure a clean contact of the switch electrodes and proper functionality.

Controller 174 is operable to supply a positive charge or voltage to a pair of lower electrodes 178 that are diametrically opposed to one another to generate a differential voltage across the upper and lower electrodes. The electrostatic force pulls upper electrodes 182 into contact with lower electrodes 178. When upper electrodes 182 move down sufficiently to contact lower electrodes 178 to make an electrostatic connection, lower electrodes 178 is RF coupled to microstrip patch element 200 and upper electrodes 182, and microstrip patch element 200 becomes capacitively coupled to ground, thus creating a short circuit plane across the patch element to phase shift the signal.

Figure 6A:
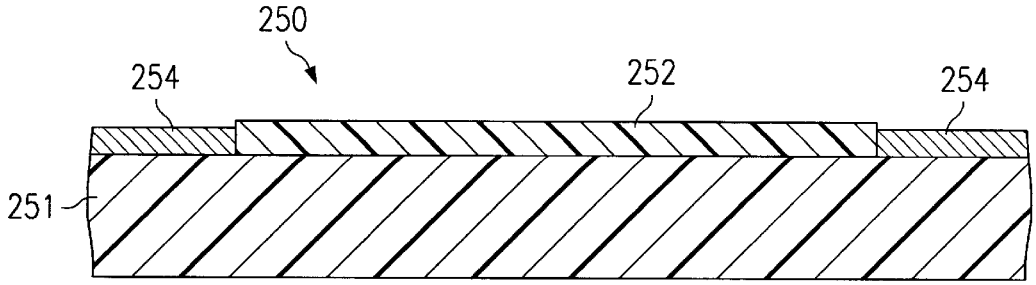
FIGS. 6A–6F are greatly enlarged elevational cross-sectional views of progressive stages in the fabrication of a microelectromechanical phase shifting switch constructed according an embodiment of the present invention.
Figure 6B:
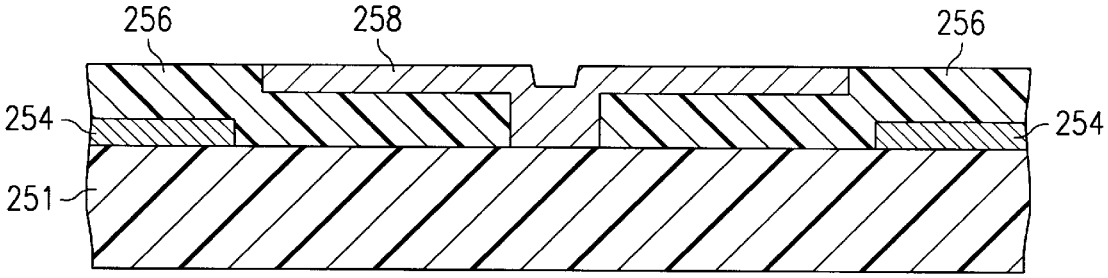
Figure 6C:
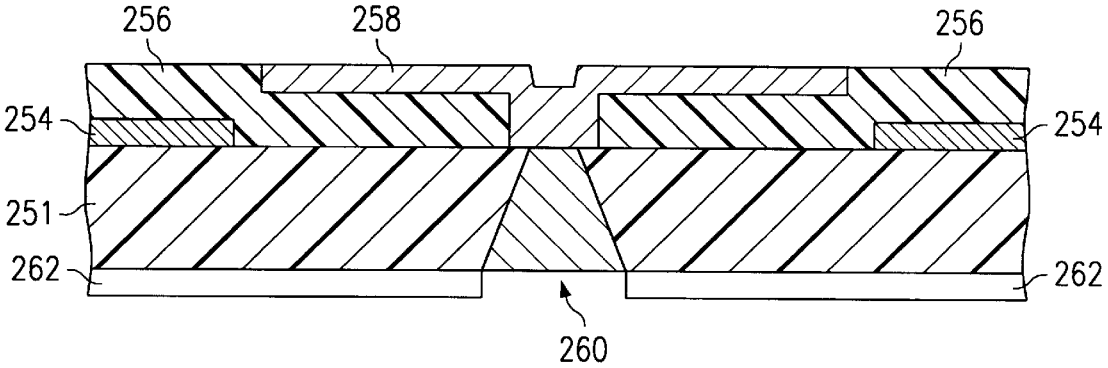
Figure 6D:
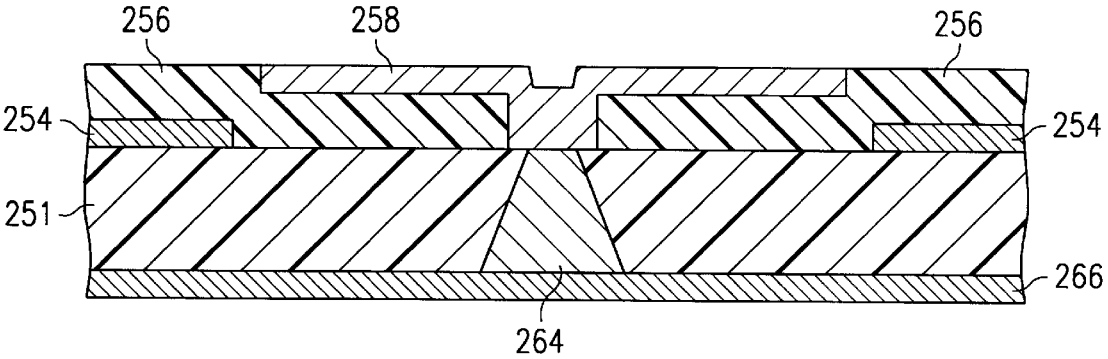
Figure 6E:
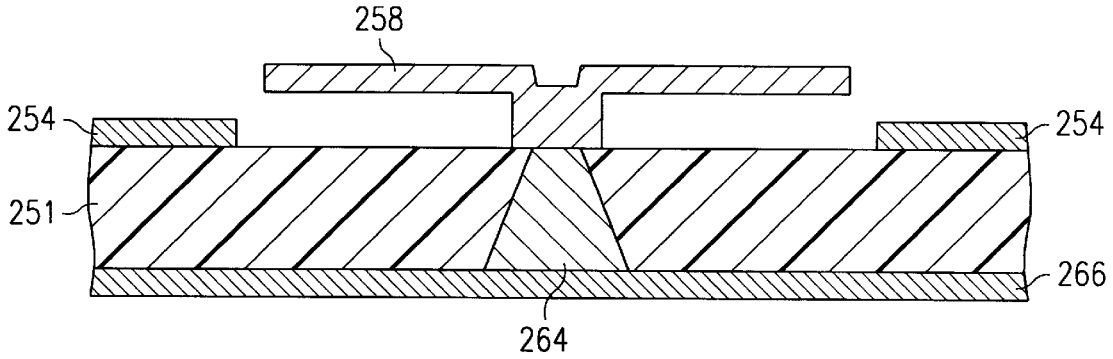

FIGS. 6A through 6F are greatly enlarged cross-sectional elevational views of progressive stages in the fabrication of a microelectromechanical phase shifting switch constructed according to an embodiment of the present invention. The entire antenna with its matrix of array elements may be fabricated simultaneously in this manner. In FIGS. 6A and 6B, a sacrificial layer of photoresist 252 is formed on a first surface of a dielectric substrate 251. The material of dielectric substrate 251 may be selected with the cost in mind together and the preferred characteristics of a low dielectric constant and loss tangent. A material such as fused quartz may be used. Metal layers 254 and 258 forming the patch element and the lower electrode of the microelectromechanical switch are then formed and patterned. Surface micromachining techniques may be used to form the lower electrode. A layer of photoresist may be used to function as a temporary spacer for the formation of the electrode. In FIG. 6C, a via 260 is etched into dielectric substrate 251, reaching lower electrode 258. In FIG. 6D, via 260 is filled with metal 264 and a metal layer 266 forming the ground plane is formed on the second surface of dielectric substrate 251. In FIG. 6E, the photoresist spacer is then removed or etched away to release the moveable lower electrode.

Figure 6F:
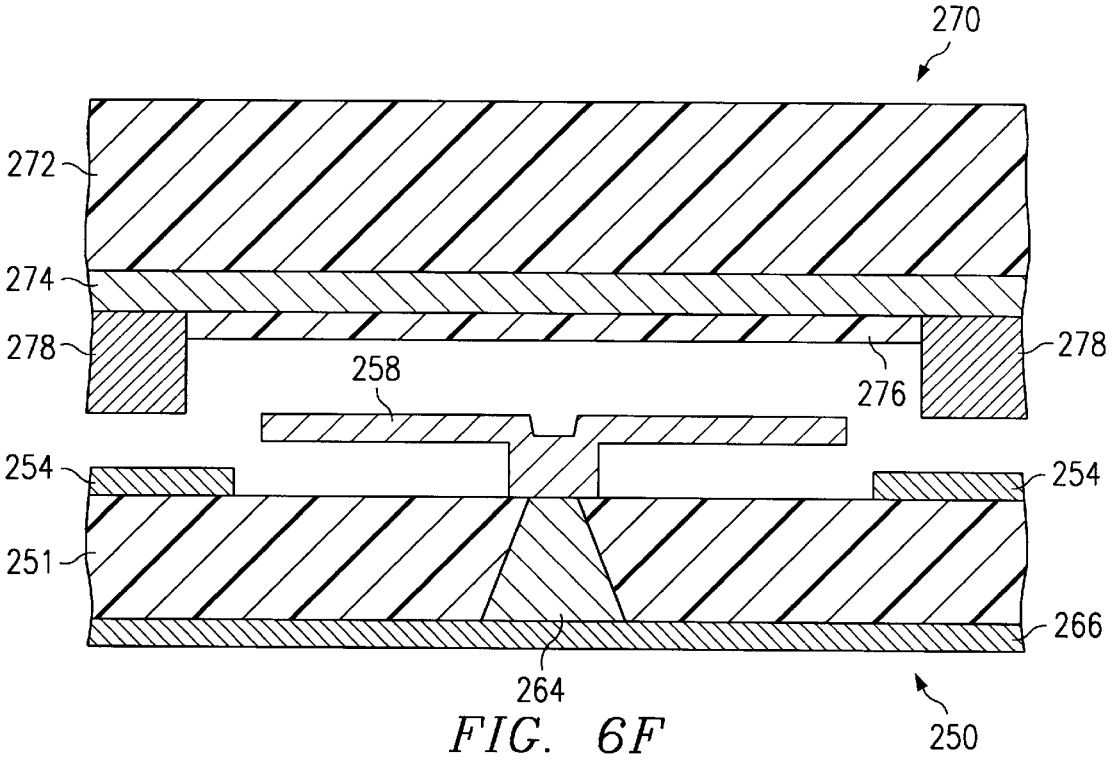

The upper electrode may be fabricated on a silicon substrate using standard metalization as part of a CMOS process, for example, used to fabricate controller 272. Referring to FIG. 6F, a metal layer 274 forming the upper electrode is fabricated adjacent to controller 272 and is electrically coupled thereto. Vertical structural members 278 are also formed. The upper electrode is covered with a dielectric layer 276 to form a capacitively coupled switch.

Finally, the two portions of the array element is assembled or otherwise bonded together into an integrated package. This step may be performed by conventional surface mount pick-and-place methods. Upper portion 270 of each array element is bonded to the lower portion 250, forming electrical connection between the patch element and the upper electrode. A number of low temperature bonding techniques may be used. For example, the material of the vertical structural members and/or sealing members may be patterned out of gold with a layer of indium on top. When these structures are placed in contact with the gold material of the patch element and heated up to approximately 155° C., a bond is created. This particular technique is called the solid-liquid-interdiffusion (SLID) process. This bonding process is repeated until all array elements on the antenna are packaged and sealed in this manner.

Constructed as described above, the reflect array elements including the integrated microelectromechanical switches therein are individually packaged and sealed from the environment. It may be seen that conventional semiconductor fabrication processes may be used to produce the phase shifting reflect array antenna. The construction of this phase shifting reflect array antenna requires substantially lower production cost due to the elimination of high cost GaAs MMIC phase shifters and amplifiers at each array element.

As a phase shifting device, the integrated microelectromechanical phase shifting reflect array antenna has lower loss compared to conventional phase shifters. For example, in a conventional 4-bit delay line phase shifter, the signal must travel through as many as eight switches and associated delay-lines. In the array antenna of the present invention, the number of switches is reduced to two with each carrying only half of the signal current. Additionally, the path length required to short the array element is significantly shorter than the shortest phase shifting path of a typical delay line phase shifter. Thus, transmission line loss, which accounts for a substantial portion of the overall loss in delay line phase shifters, is negligible in the reflect array antenna of the present invention. Furthermore, due to its space feed, the reflect array antenna offers higher power capabilities and lower loss than conventional phased arrays with lossy feed networks.

Although several embodiments of the present invention and its advantages have been described in detail, it should be understood that mutations, changes, substitutions, transformations, modifications, variations, and alterations can be made therein without departing from the teachings of the present invention, the spirit and scope of the invention being set forth by the appended claims.

What is claimed is:

1. An antenna element, comprising:

a non-electrically conductive substrate having first and second sides;

an electrically conductive patch formed on the first side of the substrate;

a ground plane formed on the second side of the non-electrically conductive substrate;

at least two pairs of integrated microelectromechanical switches arranged diametrically opposed across the patch on the first side of the substrate, each microelectromechanical switch having a first electrode electrically coupled to the patch and a second electrode electrically coupled to the ground plane, the first and second electrodes being operable to be capacitively coupled, thereby creating a short circuit plane across the patch; and a sealing structure hermetically packaging the microelectromechanical switches.

2. The antenna element, as set forth in claim 1, wherein the first electrode of each microelectromechanical switch is moveable from a neutral position to a displaced position capacitively coupling to the second electrode.

3. The antenna element, as set forth in claim 1, wherein the second electrode of each microelectromechanical switch is moveable from a neutral position to a displaced position capacitively coupling to the first electrode.

4. The antenna element, as set forth in claim 1, further comprising:

a controller integrated circuit electrically coupled to the first electrode; and a sealing structure member coupled between the controller integrated circuit and the patch operable to hermetically seal off the microelectromechanical switches from the environment.

5. The antenna element, as set forth in claim 1, wherein each microelectromechanical switch comprises a dielectric layer disposed between the first and second electrodes.

6. The antenna element, as set forth in claim 1, further comprising:

a controller integrated circuit electrically coupled to the first electrode;

a first via disposed in the substrate electrically coupling the controller integrated circuit to the ground plane; and a second via disposed in the substrate electrically coupling the controller integrated circuit to a power bus disposed on the second side of the substrate.

7. The antenna element, as set forth in claim 1, further comprising:

a via disposed in the substrate electrically coupling the controller integrated circuit to a control bus disposed on the second side of the substrate; and another via disposed in the substrate electrically coupling the controller integrated circuit to a data bus disposed on the second side of the substrate.

8. The antenna element, as set forth in claim 1, further comprising a via disposed in the substrate electrically coupling the center of the patch to the ground plane.

9. An antenna element, comprising:

a first portion including:

a non-electrically conductive substrate having first and second sides;

an electrically conductive patch formed on the first side of the substrate;

a ground plane formed on the second side of the non-electrically conductive substrate; and lower electrodes of at least two pairs of microelectromechanical switches arranged diametrically opposed across the patch and electrically coupled to the patch;

a second portion including:

a controller integrated circuit; and upper electrodes of the at least two pairs of microelectromechanical switches electrically coupled to the controller integrated circuit, the lower and upper electrodes being operable to be capacitively coupled, thereby creating a short circuit plane across the patch; and a sealing structure disposed between the first and second portions and bonding the first and second portions together and hermetically packaging the at least two pairs of microelectromechanical switches.

10. The antenna element, as set forth in claim 9, wherein the lower electrode of each microelectromechanical switch is moveable from a neutral position to a displaced position capacitively coupling to the upper electrode.

11. The antenna element, as set forth in claim 9, wherein the upper electrode of each microelectromechanical switch is moveable from a neutral position to a displaced position capacitively coupling to the lower electrode.

12. The antenna element, as set forth in claim 9, wherein each microelectromechanical switch comprises a dielectric layer disposed between the lower and upper electrodes.

13. The antenna element, as set forth in claim 9, further comprising:

a first via disposed in the substrate electrically coupling the controller integrated circuit to the ground plane; and a second via disposed in the substrate electrically coupling the controller integrated circuit to a power bus disposed on the second side of the substrate.

14. The antenna element, as set forth in claim 9, further comprising:

a via disposed in the substrate electrically coupling the controller integrated circuit to a control bus disposed on the second side of the substrate; and another via disposed in the substrate electrically coupling the controller integrated circuit to a data bus disposed on the second side of the substrate.

15. The antenna element, as set forth in claim 9, further comprising a via disposed in the substrate electrically coupling the center of the patch to the ground plane.

16. The antenna element, as set forth in claim 9, further comprising a plurality of microelectromechanical switch pairs arranged diametrically opposed across the patch, the plurality of microelectromechanical switch pairs circumscribing the center of the patch.

17. The antenna element, as set forth in claim 16, wherein the microelectromechanical switch pairs are disposed approximately one-third the distance out from the center of the patch.

18. An integrated phase shifting array antenna, comprising:

a non-electrically conductive substrate having first and second sides;

a plurality of array elements arranged in a predetermined pattern on the first side of the substrate;

a ground plane formed on the second side of the non-electrically conductive substrate;

each array element including:

an electrically conductive patch formed on the first side of the substrate;

a plurality of pairs of integrated microelectromechanical switches arranged diametrically opposed across the patch on the first side of the substrate, each microelectromechanical switch having a first electrode electrically coupled to the patch and a second electrode electrically coupled to the ground plane, the first and second electrodes being operable to be capacitively coupled, thereby creating a short circuit plane across the patch; and a sealing structure disposed about the integrated microelectromechanical switches and hermetically packaging and sealing the microelectromechanical switches.

19. The antenna, as set forth in claim 18, wherein the first electrode of each microelectromechanical switch is moveable from a neutral position to a displaced position capacitively coupling to the second electrode.

20. The antenna element, as set forth in claim 18, wherein the second electrode of each microelectromechanical switch is moveable from a neutral position to a displaced position capacitively coupling to the first electrode.

21. The antenna, as set forth in claim 18, further comprising:

a controller integrated circuit electrically coupled to the first electrode of each microelectromechanical switch; and the sealing structure coupled between the controller integrated circuit and the patch operable to hermetically seal off the microelectromechanical switches from the environment.

22. The antenna, as set forth in claim 18, wherein each microelectromechanical switch comprises a dielectric layer disposed between the first and second electrodes.

23. A method of fabricating a phase shifting array antenna, comprising:

forming a plurality of electrically conductive patches arranged in a predetermined pattern on a first side of a non-electrically conductive substrate;

forming first electrodes of at least two pairs of microelectromechanical switches disposed diametrically across each patch;

forming a ground plane on a second side of the substrate;

forming an electrical connection between each of the lower electrodes to the ground plane;

forming upper electrodes of the at least two pairs of microelectromechanical switches for each patch;

forming sealing structures disposed about the upper and lower electrodes of the at least two pairs of microelectromechanical switches; and bonding the sealing structures together thereby hermetically sealing and packaging the microelectromechanical switches.

24. The method, as set forth in claim 23, further comprising:

fabricating a controller;

forming the lower electrodes disposed above the first surface of the substrate; and forming the upper electrodes on the controller and electrically coupling the controller and the upper electrodes.

25. The method, as set forth in claim 23, further comprising:

fabricating a controller;

forming the lower electrodes on the controller supported by a support member; and forming the upper electrodes on the controller and electrically coupling the controller and the upper electrodes.

26. The method, as set forth in claim 23, further comprising:

fabricating a controller;

forming the upper electrodes on the first surface of the substrate and supported by a support member; and forming the lower electrodes on the first surface of the substrate and electrically coupled to the patch.

27. The method, as set forth in claim 23, further comprising forming a plurality of buses on the second side of the substrate carrying power, data, and control signals.

* * * * *

UNITED STATES PATENT AND TRADEMARK OFFICE

CERTIFICATE OF CORRECTION

PATENT NO. : 6,195,047 B1
DATED : February 27, 2001
INVENTOR(S) : Randy J. Richards It is certified that error appears in the above-identified patent and that said Letters Patent is hereby corrected as shown below:

"Title page,"
(56) References Cited "Other Publications"

Column 1:
Line 4, After "Phased", delete "Refletcarray", and insert -- Reflectarray --.

Column 2:
Line 12, After "with", delete "Leo", and insert -- LEO --.

Claims:
Column 11:
Line 39, After "first", delete "side", and insert -- surface --.
Line 41, After "forming", delete "first", and insert -- lower --.

Column 12:
Line 1, After "second", delete "side", and insert -- surface --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*